US007987749B2

(12) United States Patent
Hsieh

(10) Patent No.: US 7,987,749 B2
(45) Date of Patent: Aug. 2, 2011

(54) WRENCH WITH A ROTATABLE HEAD

(76) Inventor: Chih-Ching Hsieh, Taichung Hsien (TW)

( * ) Notice: Subject to any disclaimer, the term of this patent is extended or adjusted under 35 U.S.C. 154(b) by 192 days.

(21) Appl. No.: 12/358,376

(22) Filed: Jan. 23, 2009

(65) Prior Publication Data

US 2010/0186557 A1 Jul. 29, 2010

(51) Int. Cl.
*B25B 23/16* (2006.01)

(52) U.S. Cl. ..... 81/177.8; 403/103

(58) Field of Classification Search ..... 81/177.7–177.9; 403/91–94, 96, 97, 103, 108
See application file for complete search history.

(56) References Cited

U.S. PATENT DOCUMENTS

| | | | | |
|---|---|---|---|---|
| 2,921,773 | A * | 1/1960 | Hoelzer | 254/129 |
| 5,768,960 | A * | 6/1998 | Archuleta | 81/177.8 |
| 6,101,907 | A * | 8/2000 | McGovern et al. | 81/177.8 |
| 6,349,620 | B1 * | 2/2002 | Anderson | 81/73 |
| 6,928,904 | B2 | 8/2005 | Hsien | |
| 7,156,003 | B2 * | 1/2007 | Cole | 81/177.8 |
| 7,237,463 | B1 * | 7/2007 | Lee | 81/177.8 |
| 7,373,861 | B2 | 5/2008 | Hsieh | |
| 7,415,911 | B2 * | 8/2008 | Cole et al. | 81/177.8 |
| 7,520,199 | B2 * | 4/2009 | Stawarski | 81/177.8 |
| 7,591,208 | B2 * | 9/2009 | Cole | 81/177.8 |
| 2009/0223328 | A1 * | 9/2009 | Hi | 81/177.8 |

FOREIGN PATENT DOCUMENTS

| | | | |
|---|---|---|---|
| EP | 0768937 | A1 | 12/1995 |
| EP | 1004403 | A2 | 5/2000 |
| WO | WO 2008/144235 | A1 | 11/2008 |

* cited by examiner

*Primary Examiner* — David B Thomas
(74) *Attorney, Agent, or Firm* — Ming Chow; Sinorica, LLC

(57) ABSTRACT

A wrench with a rotatable head comprises a handle and a head, which are connected via a first and a second ends. The first end includes an upper and a lower lugs. A first toothed hole is formed in the upper lug; a hole is formed in the lower lug. A second toothed hole is formed in the second end. The second end is inserted between the upper and lower lugs and the second toothed hole is located between the first toothed hole and the hole. A toothed pillar is movably engaged in the toothed holes. When in the engagement position, the toothed pillar is engaged with the first and second toothed holes to fix the head and the handle. When in the disengagement position, the toothed pillar is disengaged from the teeth of the first toothed hole but still engaged with the teeth of the second toothed hole, so that the head and handle are rotatable with respect to each other.

19 Claims, 6 Drawing Sheets

WRENCH WITH A ROTATABLE HEAD

BACKGROUND OF THE INVENTION

1. Field of the Invention

The present invention relates to a hand tool, and more particularly to a wrench, the head of the wrench can be fixed at different angles with respect to the handle of the wrench.

2. Description of the Prior Art

The head of a conventional wrench is normally fixed to the handle, however, if a nut or a bolt to be driven is located in an unreachable corner of a narrow space, the conventional wrench is difficult to use. The inventor of the application has disclosed U.S. Pat. No. 6,928,904 "Hand tool having a quick deriving effect" and U.S. Pat. No. 7,373,861 "Pivoting assembly of a hand tool" to make a wrench whose head is rotatable with respect to its handle, so as to allow an effective use in a narrow space.

The head of the wrench of U.S. Pat. No. 6,928,904 is formed with a toothed hole, and the front end of the handle is formed a toothed locking portion. The toothed locking portion is engaged with the toothed hole of the head of the wrench. To change the angle between the head and the handle of the wrench, the handle must be lifted up to make the toothed locking portion disengage from the toothed hole of the head, so that the angle can be adjusted, and after adjustment, the tooted locking portion is inserted into the toothed hole again to make the handle fixed at the adjusted angle with respect to the head.

The head of the wrench of U.S. Pat. No. 7,373,861 is also formed with a toothed hole, and the front end of the handle is formed a toothed locking portion for engaging with the toothed hole, and similarly, the angle between the head and the handle of the wrench can also be adjusted by lifting the handle to disengage the toothed locking portion from the mounting hole.

However, the angle adjustment of the above two wrenches requires to lift the handle, namely, to make the handle move relatively to the head, so that the head can be disengaged from the handle. In such adjustment, the user has to use two hands to lift the handle with one hand and to hold the head with the other hand, this is inconvenient.

SUMMARY OF THE INVENTION

The primary objective of the present invention is to provide a wrench with a rotatable head, the head of the wrench can be easily disengaged from the handle.

A wrench with a rotatable head in accordance with the present invention comprises a handle and at least one head which are connected via a first end and a second end, and an angle of the head with respect to the handle being adjustable. The first end includes an upper lug and a lower lug. A first toothed hole is formed in the upper lug, and a through hole is formed in the lower lug. The second end is inserted in the space between the upper and lower lugs. A second toothed hole is formed in the second end and located between the first toothed hole and the through hole. A toothed pillar is movably engaged in the toothed holes. When the toothed pillar is moved to an engagement position, the pillar is synchronously engaged with the two toothed holes, so as to fix the head and the handle, and thus the angle between them is unadjustable. When the toothed pillar is moved to a disengagement position, the pillar is disengaged from the first toothed hole but still engaged with the second toothed hole, so that the head and handle are rotatable with respect to each other.

The present invention can be best understood through the following description and accompanying drawings.

DETAILED DESCRIPTION OF THE PREFERRED EMBODIMENT

Figure 1:
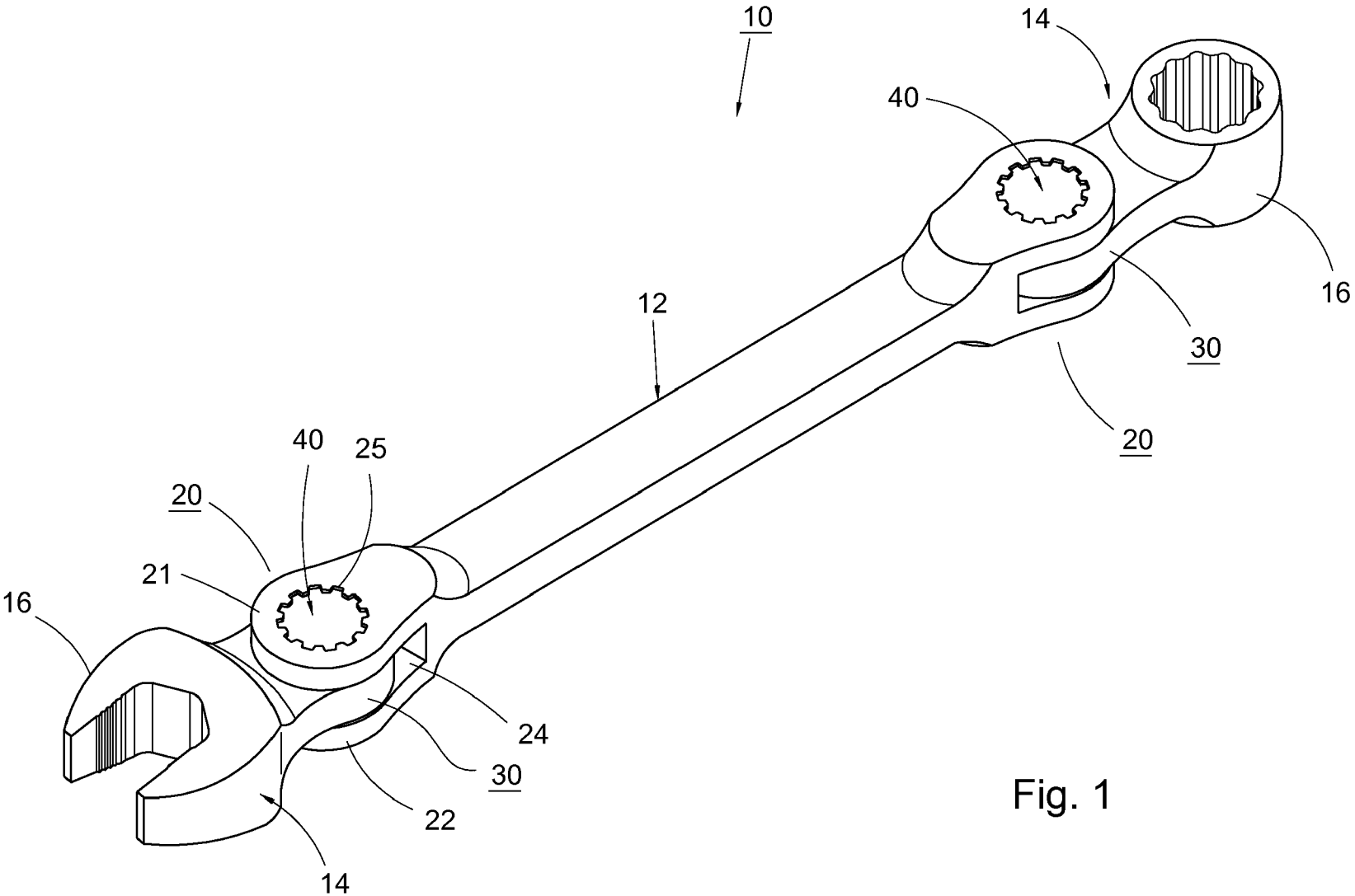
FIG. 1 is a perspective view of a preferred embodiment of the present invention.
Figure 2:
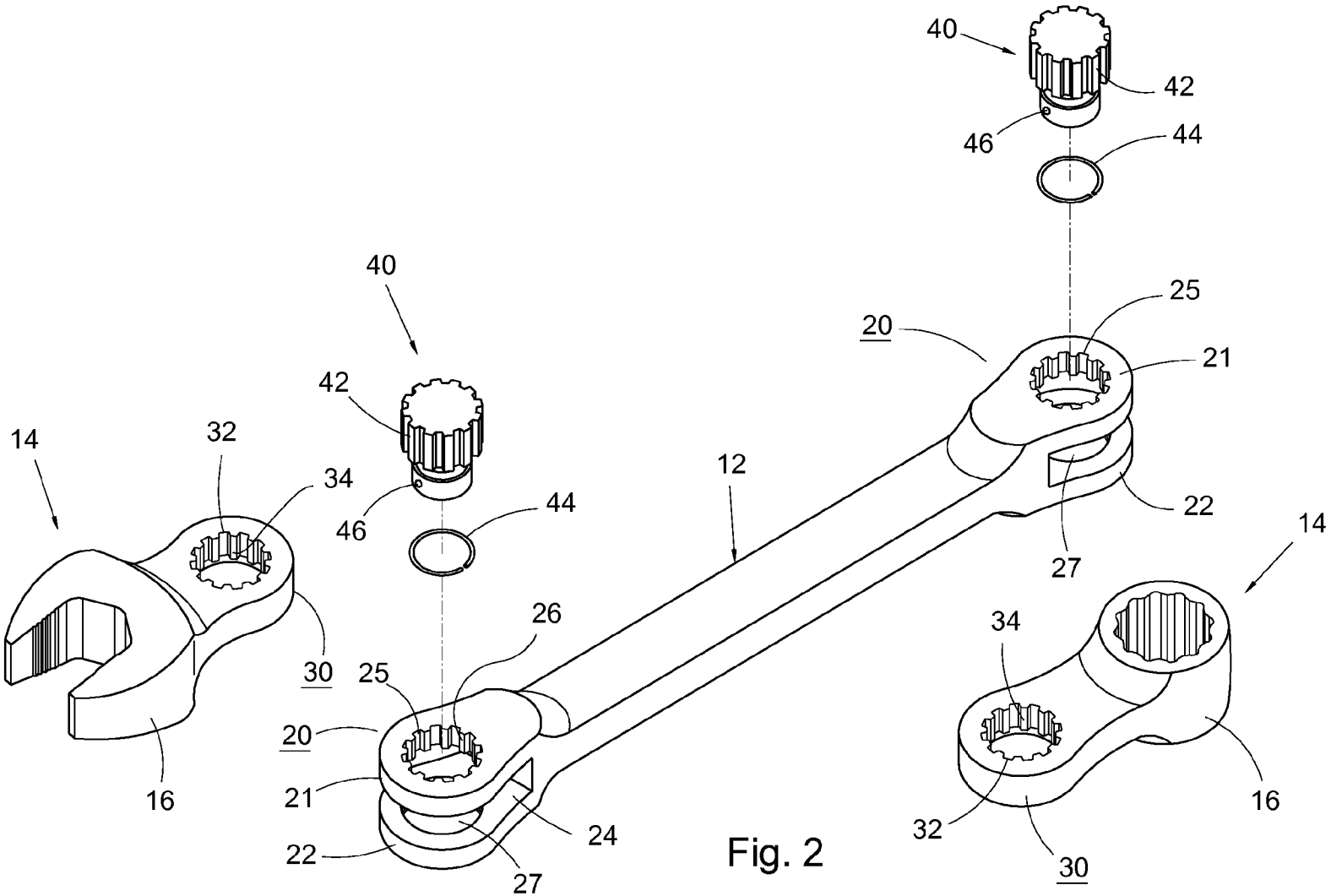
FIG. 2 is a perspective exploded view of FIG. 1.

Please referring to FIGS. 1 and 2, a wrench 10 with a rotatable head in accordance with a preferred embodiment of the present invention comprises a handle 12, both ends of the handle 12 are connected with a head 14 respectively. Each head 14 and the handle 12 are connected via a first end 20 and a second end 30, and the angle of the head 14 with respect to the handle 12 is adjustable.

The first end 20 is one end of the handle 12, and the second end 20 is one end of the head 14. It is understood that the first and second ends can be exchanged, namely, the first end 20 can be one end of the head 14, and the second end is one end of the handle 12. The other end of the head 14 is a driving end 16 for driving a nut. The driving end 16 can be an open end or a polygonal box end. The box end can also be a ratchet structure. Alternatively, the driving end 16 can be provided with a pillar (like the member 25 shown in FIG. 2 of U.S. Pat. No. 6,928,904) for engaging with sockets. The driving end is of conventional structure, so further explanation is omitted.

Figure 3:
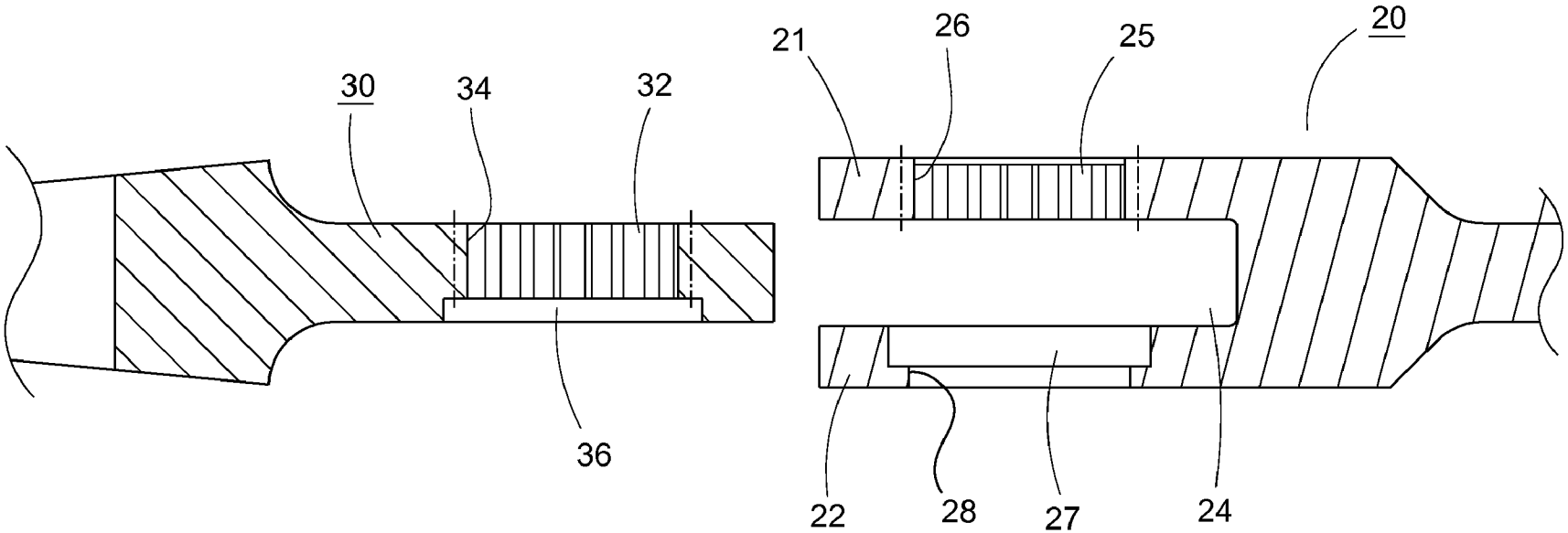
FIG. 3 is a cross sectional view of the first and second ends of the present invention.

Referring to FIG. 3, the first end 20 has an upper lug 21, a lower lug 22, and a space 24 defined between the upper and lower lugs 21, 22. A first toothed hole 25 is formed in the upper lug 21. The inner surface of the toothed hole 25 is formed with a plurality of teeth 26. A through hole 27 is formed in the lower lug 22 and aligned with the toothed hole 25. A restriction flange 28 is formed on the inner surface of the hole 27.

The second end 30 is formed with a second toothed hole 32 and a plurality of teeth 34 formed on the inner surface of the toothed hole 32. The second end 30 is inserted in the space 24 and is located between the upper and lower lugs 21, 22. The second toothed hole 32 is aligned with the first toothed hole 25 and the through hole 27. In this embodiment, the lower end of the inner surface of the second toothed hole 32 is not provided with tooth and defines a hole portion 36 which is not a necessary structure of the present invention.

Figure 4:
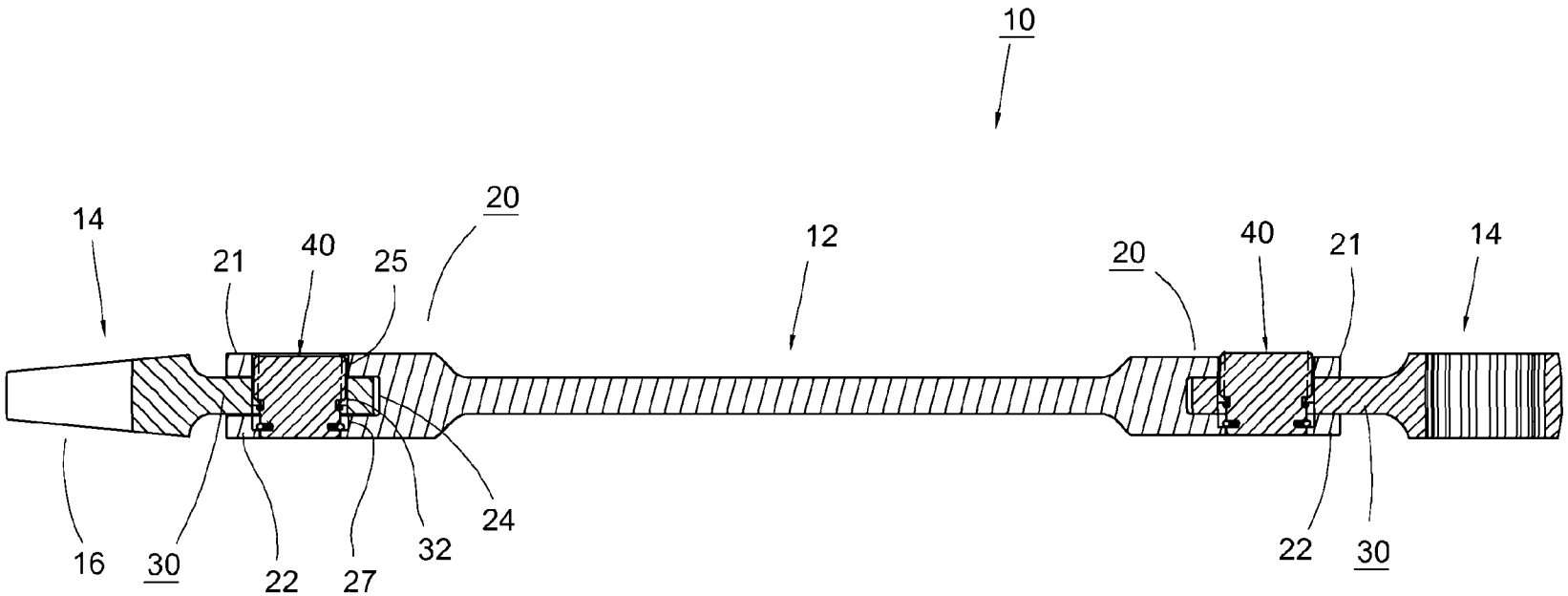
FIG. 4 is a longitudinal cross sectional view of FIG. 1.

A toothed pillar 40 is formed around its periphery with a plurality of teeth 42. In this embodiment, the teeth 42 are formed only on the top side of the periphery of the toothed pillar 40, but can also be formed on the full area of the outer periphery of the pillar 40. The toothed pillar 40 is installed in the toothed holes 25, 32 and the hole 27, as shown in FIGS. 4 and 5, so that the first end 20 and the second end 30 are jointed to each other.

Figure 5:
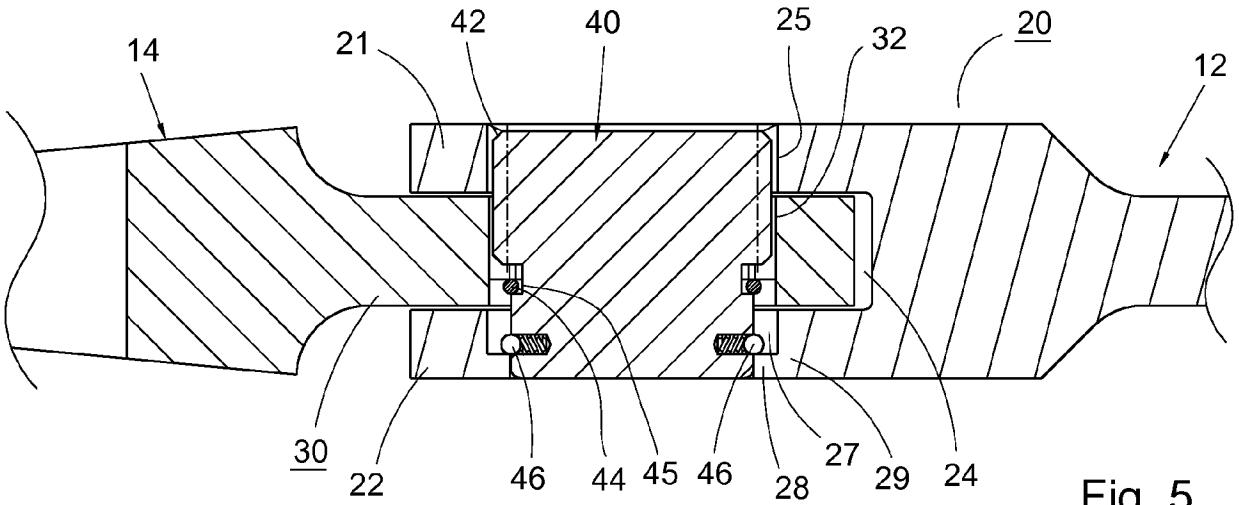
FIG. 5 is a magnified view of a part of FIG. 4.
Figure 6:
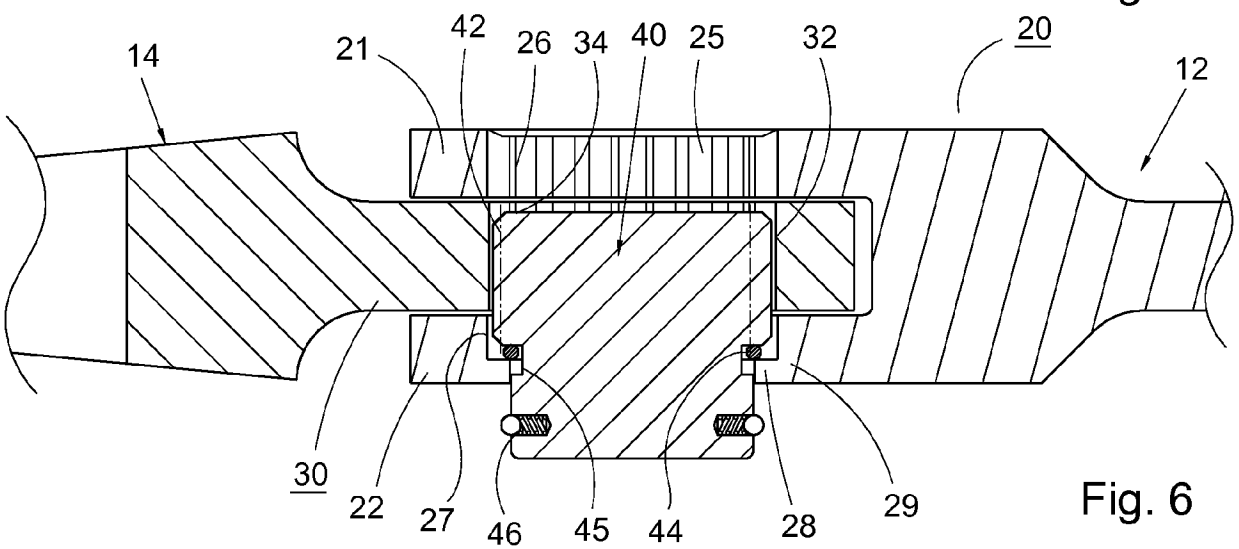
FIG. 6 shows that the toothed pillar is in the disengagement position.

The toothed pillar 40 can be moved to an engagement position as shown in FIG. 5, or to a disengagement position as shown in FIG. 6. Specifically, the outer periphery of the toothed pillar 40 is arranged an abutting flange 44 which is in the form of a C-shaped retainer and engaged in an annular groove 45 formed on the outer periphery of the toothed pillar. The outer diameter of the abutting flange 44 is larger than the inner diameter of the second toothed hole 32 of the second end 30. Therefore, by way of the abutting flange 44 being abutted against the bottom of the second toothed hole 32, as shown in FIG. 5, so as to prevent the toothed pillar 40 from slipping out of the toothed holes 25 and 32 when moving upward. When the toothed pillar 40 is moved downward to the disengagement position as shown in FIG. 6, by way of the abutting flange 44 abutting against the restriction flange 28 (or the bottom of the teeth 42 abuts against the restriction flange 28), to prevent the pillar from slipping out of the holes. At least one elastic positioning member 46, which comprises a spring and a steel ball for example, is embedded in the lower side of the toothed pillar 40 and located under the abutting flange 44. The elastic positioning member elastically protrudes out of the outer periphery of the toothed pillar.

In use, as shown in FIGS. 1 and 5, when the toothed pillar 40 is in the engagement position, the toothed pillar is inserted in the first and second toothed holes 25, 32, and the teeth 42 of the toothed pillar are synchronously engaged with the teeth of the first and second toothed holes 25, 32, so as to fix the first and second ends 20 and 30 and prevent them from rotating relatively. In this case, the head 14 can be used to drive a nut by wrenching the handle 12. The elastic positioning member 46 of the toothed pillar 40 is abutted against the top face of the restriction flange 28 to keep the toothed pillar in the engagement position. Preferably, the abutting flange 44 is meanwhile abutted against the bottom face of the second end 30 so that the toothed pillar 40 is well positioned in the engagement position.

Figure 7:
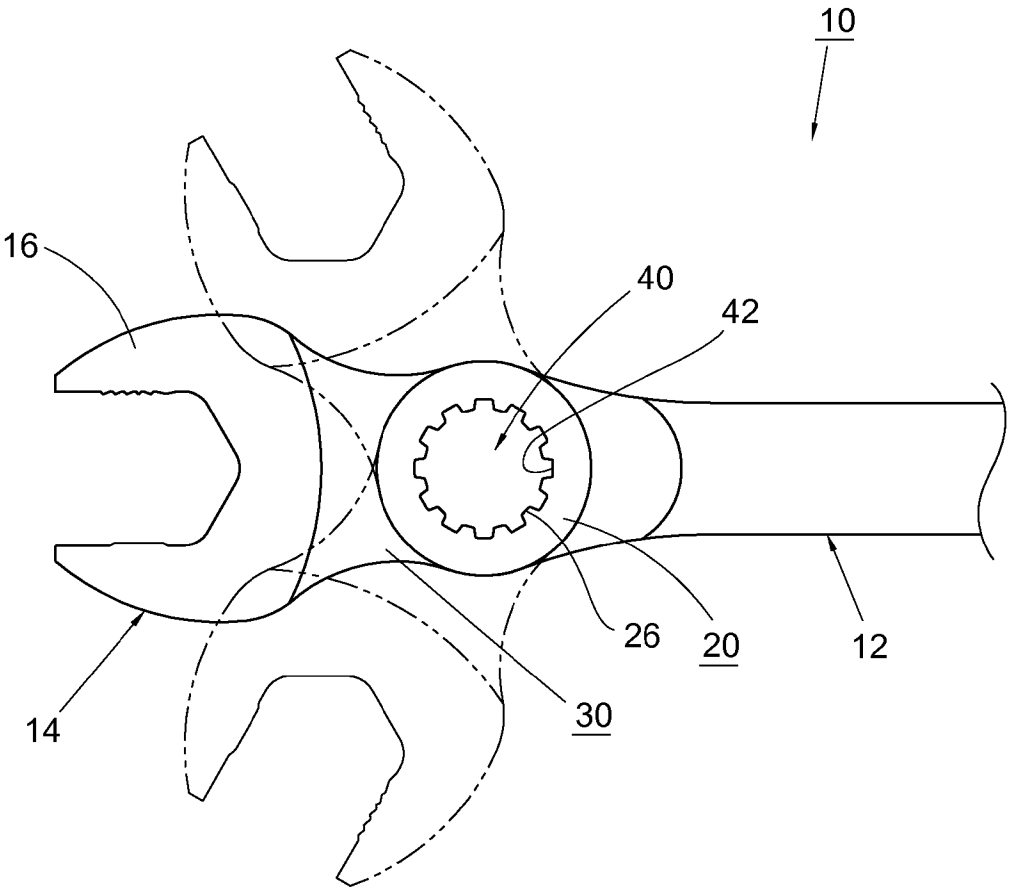
FIG. 7 is a top view of a part of FIG. 1.

When pressing down the toothed pillar 40, the toothed pillar is moved to the disengagement position as shown in FIG. 6, and is disengaged from the first toothed hole 25. At this moment, the toothed pillar 40 is only engaged with the second toothed hole 32, accordingly, the first end 20 and the second end 30 are disengaged from each other and can be rotated with respect to each other, so that the head 14 and the handle 12 can be rotated about the toothed pillar 40, as shown in FIG. 7. After the head 14 is rotated to a desired angular position, the first and second ends 20, 30 can be engaged with each other again by pressing the toothed pillar 40 back to the engagement position, as shown in FIG. 5.

When the toothed pillar 40 is moved from the engagement position to the disengagement position or from the disengagement position to the engagement position, the elastic positioning member 46 will slide over the restriction flange 28.

When releasing the first and second ends from the engagement position as shown in FIG. 5 to the disengagement position as shown in FIG. 6, it only needs to move the toothed pillar 40 within the toothed holes 25 and 32 without moving the handle 12 and the head 14 with respect to each other. Hence, the user can disengage the head 14 and the handle 12 by pressing the toothed pillar 40 with the thumb of the hand holding the handle 12. In other words, the head 12 and the handle 14 can be disengaged with only one hand, it is very convenient in use. The head can be easily engaged with or disengaged from the handle by pressing the pillar. In addition, the present invention is simple in structure and easy to use.

While I have shown and described the preferred embodiment in accordance with the present invention, it is clear to those skilled in the art that further embodiments may be made without departing from the scope of the present invention.

What is claimed is:

1. A wrench with a rotatable head comprising:

a handle and at least one head, the handle and the head are connected via a first end and a second end, and an angle of the head with respect to the handle being adjustable, wherein:

the first end includes an upper lug, a lower lug, and a space defined between the upper and lower lugs; a first toothed hole is formed in the upper lug, the inner surface of the first toothed hole is formed with a plurality of teeth; a through hole is formed in the lower lug and aligned with the first toothed hole;

a second toothed hole is formed in the second end and the inner surface of the toothed hole is formed with a plurality of teeth; the second end is inserted in the space between the upper and lower lugs and the second toothed hole is located between the first toothed hole and the through hole; and a toothed pillar, the periphery of the toothed pillar is formed with a plurality of teeth, the toothed pillar is movably engaged in the toothed holes, the toothed pillar can be moved upward to an engagement position or be moved downward to a disengagement position; when the toothed pillar is in the engagement position, the teeth of the toothed pillar are synchronously engaged with the teeth of the first and second toothed holes; when the toothed pillar is in the disengagement position, the teeth of the toothed pillar are disengaged from the teeth of the first toothed hole and only engaged with the teeth of the second toothed hole, wherein at least one elastic positioning member is disposed on a lower side of an outer periphery of the toothed pillar; when the toothed pillar is in the engagement position, the elastic positioning member is abutted against an inner surface of the through hole.

2. The wrench as claimed in claim 1, wherein a restriction flange is formed on the inner surface of the through hole; when the toothed pillar is in the engagement position, the elastic positioning member is abutted against the restriction flange.

3. The wrench as claimed in claim 2, wherein an abutting flange is formed on the outer periphery of the toothed pillar and located above the elastic positioning member, an outer diameter of the abutting flange is larger than an inner diameter of the second toothed hole of the second end; when the toothed pillar is in the engagement position, the abutting flange is abutted against a bottom face of the second toothed hole.

4. The wrench as claimed in claim 3, wherein the teeth of the toothed pillar are formed only on a top side of the periphery of the toothed pillar.

5. The wrench as claimed in claim 1, wherein a hole portion with a larger diameter is formed in a lower side of the second toothed hole.

6. The wrench as claimed in claim 1, wherein an abutting flange is formed on the outer periphery of the toothed pillar and located above the elastic positioning member, an outer diameter of the abutting flange is larger than an inner diameter of the second toothed hole of the second end; when the toothed pillar is in the engagement position, the abutting flange is abutted against a bottom face of the second toothed hole.

7. The wrench as claimed in claim 1, wherein a restriction flange is formed on an inner surface of the through hole; when the toothed pillar is in the disengagement position, the restriction flange is abutted against an abutting flange.

8. The wrench as claimed in claim 7, wherein an abutting flange is formed on the outer periphery of the toothed pillar;

when the toothed pillar is in the disengagement position, the abutting flange is abutted against a top face of the restriction flange.

9. The wrench as claimed in claim 1, wherein the teeth of the toothed pillar are formed only on a top side of the periphery of the toothed pillar.

10. A wrench with a rotatable head comprising:

a handle and at least one head, the handle and the head are connected via a first end and a second end, and an angle of the head with respect to the handle being adjustable, wherein the first end includes an upper lug, a lower lug, and a space defined between the upper and lower lugs; a first toothed hole is formed in the upper lug, the inner surface of the first toothed hole is formed with a plurality of teeth; a through hole is formed in the lower lug and aligned with the first toothed hole;

a second toothed hole is formed in the second end and the inner surface of the toothed hole is formed with a plurality of teeth; the second end is inserted in the space between the upper and lower lugs and the second toothed hole is located between the first toothed hole and the through hole; and a toothed pillar, the periphery of the toothed pillar is formed with a plurality of teeth, the toothed pillar is movably engaged in the toothed holes, the toothed pillar can be moved upward to an engagement position or be moved downward to a disengagement position; when the toothed pillar is in the engagement position, the teeth of the toothed pillar are synchronously engaged with the teeth of the first and second toothed holes; when the toothed pillar is in the disengagement position, the teeth of the toothed pillar are disengaged from the teeth of the first toothed hole and only engaged with the teeth of the second toothed hole, wherein an abutting flange is formed on the outer periphery of the toothed pillar, an outer diameter of the abutting flange is larger than an inner diameter of the second toothed hole of the second end; when the toothed pillar is in the engagement position, the abutting flange is abutted against a bottom face of the second toothed hole.

11. The wrench as claimed in claim 10, wherein the abutting flange is a C-shaped retainer which is mounted on the outer periphery of the toothed pillar.

12. The wrench as claimed in claim 10, wherein a restriction flange is formed on an inner surface of the through hole; when the toothed pillar is in the disengagement position, the restriction flange is abutted against an abutting flange.

13. The wrench as claimed in claim 12, wherein an abutting flange is formed on the outer periphery of the toothed pillar; when the toothed pillar is in the disengagement position, the abutting flange is abutted against a top face of the restriction flange.

14. The wrench as claimed in claim 12, wherein the teeth of the toothed pillar are formed only on a top side of the periphery of the toothed pillar.

15. The wrench as claimed in claim 10, wherein the teeth of the toothed pillar are formed only on a top side of the periphery of the toothed pillar.

16. A wrench with a rotatable head comprising:

a handle and at least one head, the handle and the head are connected via a first end and a second end, and an angle of the head with respect to the handle being adjustable, wherein, the first end includes an upper lug, a lower lug, and a space defined between the upper and lower lugs; a first toothed hole is formed in the upper lug, the inner surface of the first toothed hole is formed with a plurality of teeth; a through hole is formed in the lower lug and aligned with the first toothed hole;

a second toothed hole is formed in the second end and the inner surface of the toothed hole is formed with a plurality of teeth; the second end is inserted in the space between the upper and lower lugs and the second toothed hole is located between the first toothed hole and the through hole; and a toothed pillar, the periphery of the toothed pillar is formed with a plurality of teeth, the toothed pillar is movably engaged in the toothed holes, the toothed pillar can be moved upward to an engagement position or be moved downward to a disengagement position; when the toothed pillar is in the engagement position, the teeth of the toothed pillar are synchronously engaged with the teeth of the first and second toothed holes; when the toothed pillar is in the disengagement position, the teeth of the toothed pillar are disengaged from the teeth of the first toothed hole and only engaged with the teeth of the second toothed hole, wherein a restriction flange is formed on an inner surface of the through hole; when the toothed pillar is in the disengagement position, the restriction flange is abutted against an abutting flange.

17. The wrench as claimed in claim 16, wherein an abutting flange is formed on the outer periphery of the toothed pillar; when the toothed pillar is in the disengagement position, the abutting flange is abutted against a top face of the restriction flange.

18. The wrench as claimed in claim 16, wherein the teeth of the toothed pillar are formed only on a top side of the periphery of the toothed pillar.

19. A wrench with a rotatable head comprising:

a handle and at least one head, the handle and the head are connected via a first end and a second end, and an angle of the head with respect to the handle being adjustable, wherein, the first end includes an upper lug, a lower lug, and a space defined between the upper and lower lugs; a first toothed hole is formed in the upper lug, the inner surface of the first toothed hole is formed with a plurality of teeth; a through hole is formed in the lower lug and aligned with the first toothed hole;

a second toothed hole is formed in the second end and the inner surface of the toothed hole is formed with a plurality of teeth; the second end is inserted in the space between the upper and lower lugs and the second toothed hole is located between the first toothed hole and the through hole; and a toothed pillar, the periphery of the toothed pillar is formed with a plurality of teeth, the toothed pillar is movably engaged in the toothed holes, the toothed pillar can be moved upward to an engagement position or be moved downward to a disengagement position; when the toothed pillar is in the engagement position, the teeth of the toothed pillar are synchronously engaged with the teeth of the first and second toothed holes; when the toothed pillar is in the disengagement position, the teeth of the toothed pillar are disengaged from the teeth of the first toothed hole and only engaged with the teeth of the second toothed hole, wherein the teeth of the toothed pillar are formed only on a top side of the periphery of the toothed pillar.

* * * * *